United States Patent [19]

Lusch

[11] 4,197,816

[45] Apr. 15, 1980

[54] MULTI-PURPOSE HUMAN HARNESS

[76] Inventor: Charles Lusch, 805 Broadway Ave., Cardiff, N.J. 08232

[21] Appl. No.: 894,563

[22] Filed: Apr. 7, 1978

[51] Int. Cl.[2] ..... A62B 35/00

[52] U.S. Cl. ..... 119/96; 182/6

[58] Field of Search ..... 119/96; 182/6, 7, 8, 182/9; 224/5 BC

[56] References Cited

U.S. PATENT DOCUMENTS

| | | | |
|---|---|---|---|
| Re. 28,273 | 12/1974 | Brda | 182/6 |
| 148,744 | 3/1874 | Parent | 182/6 |
| 194,507 | 8/1877 | Van Wie | 182/9 |
| 283,159 | 8/1883 | Spencer | 182/6 |
| 293,799 | 2/1884 | Simkin | 119/96 X |
| 481,923 | 9/1892 | Badger | 182/7 |
| 630,902 | 8/1899 | Laming | 182/6 |
| 1,298,615 | 3/1919 | Wilkinson | 182/3 X |
| 1,642,911 | 9/1927 | Thurnau | 182/6 |
| 2,149,803 | 3/1939 | Wight | 119/96 |
| 2,426,768 | 9/1947 | Farmer et al. | 224/5 BC |
| 2,574,178 | 11/1951 | Haller | 119/96 |
| 2,647,293 | 8/1953 | Wintercorn | 182/6 |
| 2,685,331 | 8/1954 | Gauntlett et al. | 155/189 |
| 2,979,028 | 4/1961 | Zakely | 119/96 |
| 3,322,102 | 5/1967 | Windle | 119/96 |
| 3,498,408 | 3/1970 | Foote | 182/6 |
| 3,701,395 | 10/1972 | Theobald | 182/3 |
| 3,703,218 | 11/1972 | Brda | 182/6 |
| 3,717,219 | 2/1973 | Hoffman | 182/6 |
| 3,738,449 | 6/1973 | Arancio | 182/3 |
| 3,739,875 | 6/1973 | Clark-Padwicki | 182/6 |
| 3,757,744 | 9/1973 | Pravaz | 119/96 |
| 3,973,643 | 8/1976 | Hutchinson | 182/3 |

*Primary Examiner*—Hugh R. Chamblee

*Attorney, Agent, or Firm*—George A. Smith, Jr.

[57] ABSTRACT

A harness of nylon webbing or similar material consists of a belt having a ring at one end and a snap hook at the other end, a short length of webbing is secured to the belt at an intermediate portion thereof offset toward the end having the ring. A second ring is provided at the end of this short length of webbing for attachment of the belt to a rope either directly or through a snap link. Straps are permanently secured to the belt immediately on either side of the short length of webbing. These straps have snap hooks at their opposite ends. A third ring is connected through a second short length of webbing to an intermediate location on the belt part way between the snap hook at the end of the belt and the locations at which the straps and the first short length of webbing are attached to the belt. This harness may be worn with the belt around the waist and with the straps used as leg straps. Worn this way, it is useful for rappelling, climbing, sliding, and for some rescue purposes. The harness may also be worn around the upper torso with the straps extending over the shoulders and crossed. When worn this way, the harness can be used for rescue purposes, and also as a safety harness for construction workers.

5 Claims, 8 Drawing Figures

MULTI-PURPOSE HUMAN HARNESS

BRIEF SUMMARY OF THE INVENTION

This invention relates to the art of human harnesses, and in particular to a multi-purpose harness for climbing, rappelling, rescue and the like. The invention has particular utility in police, fire, rescue and military work and is adapted to be carried at all times by an individual engaged in such activities, and put to use whenever it is needed.

Many examples of harnesses are found in the prior art. For example, Foote U.S. Pat. No. 3,498,408, Hutchinson U.S. Pat. No. 3,973,643 and Arancio U.S. Pat. No. 3,738,449 all disclose harnesses of the kind used by firemen for securing themselves on ladders, for lowering themselves by means of ropes from high places, and for similar purposes. The harness disclosed in U.S. Pat. No. 3,738,449 is also described as useful in rescue for quick removal of persons trapped by fire or other hazardous situations.

Numerous patents, of which U.S. Pat. No. 481,923 to A. A. Badger is a typical example, describe harnesses for lowering persons from buildings in the event of fire. The harness in the Badger patent contemplates the support of the person to be rescued in a sitting position. Brda U.S. Pat. No. Re. 28,273 describes another rescue harness which is adapted to support the victim in a sitting position. Zakely U.S. Pat. No. 2,979,028 and Windle U.S. Pat. No. 3,322,102 describe body harnesses adapted to support unconscious victims. These harnesses are adapted to be secured simultaneously to the legs and upper torso of the victim.

Farmer et al. U.S. Pat. No. 2,426,768 describes a typical safety harness of the type used by construction workers. This harness extends around the upper torso of the body and utilizes shoulder straps.

The harnesses of the prior art, as exemplified by the above-mentioned patents, are generally useful only for limited purposes. That is, a harness designed for rescue is generally not well adapted for rappelling or sliding. Similarly, a harness adapted for sliding or rappelling is normally not well-adapted for rescue. Even the harness of the Arancio patent, while useful for multiple purposes, is not adapted for the rescue of unconscious victims, since it contemplates a sitting position, which an unconscious victim cannot maintain.

The principal object of the present invention is to provide a harness which is simple and inexpensive in construction, which is compact, and which is adapted to perform in a superior manner in a wide variety of applications. The harness in accordance with the invention comprises a flexible belt having means for adjusting its length and having means for securing its ends together to form a closed loop. The belt is adapted to extend circumferentially around the waist, and is also adapted to extend alternatively around the upper torso of the wearer. A metal ring is provided, and flexible means, typically a short length of webbing, secures the ring to an intermediate location on the belt, preferably substantially offset one side of the point midway between the ends of the belt. A first flexible strap is secured at one of its ends to an intermediate location on the belt on one side of the location to which the ring is secured. A second flexible strap is secured at one of its ends to an intermediate location on the belt on the opposite side of the location to which the ring is secured. Both flexible straps have means for adjusting their lengths. Two attachment rings are provided, secured to the belt at locations such that the locations to which the flexible straps are secured to the belt are located between the locations to which the attachment rings are secured. Snap hooks are provided on each strap, at the end thereof opposite the end secured to the belt, and are adapted to be removably secured to either one of the attachment rings.

In a preferred form of the harness, one of the attachment rings is located at an end of the belt, and attaches to a snap hook at the other end of the belt to form the closed loop, and to one or the other of the snap hooks at the ends of the straps, depending on the configuration in which the harness is to be used.

The harness thus constructed may be worn either with the flexible belt around the waist and with the first and second straps extending uncrossed between the legs of the wearer, or alternatively with the belt around the upper torso and the straps extending over the wearer's shoulders and crossing each other. When the harness is worn with the belt around the waist, it can be used for rappelling, climbing, sliding (on an inclined rope), and for the raising and lowering of conscious victims. When worn with the belt around the upper torso, the harness can be used to raise and lower unconscious victims, or alternatively as a safety harness, to break the fall of a person working in a dangerously high location.

The harness is continuously adjustable and can accommodate persons in a wide range of sizes. It is tightenable so that it can be made to fit perfectly, an advantage especially important in the raising and lowering of unconscious persons, who would tend to slip out of an imperfectly fitting harness. It is also adapted for quick removal from the body, which is an especially important advantage when the harness is used to lower rescue workers, military personnel and others from helicopters.

Because of its wide range of possible uses and also by virtue of its ability to be worn by persons in a wide range of sizes, this harness can take the place of several of the more specialized harnesses of the prior art, thereby reducing the equipment expenditures of law enforcement agencies, fire departments, military units and the like.

Numerous other objects and advantages of the invention will be apparent from the detailed description when read in conjunction with the drawings.

DETAILED DESCRIPTION

Figure 1:
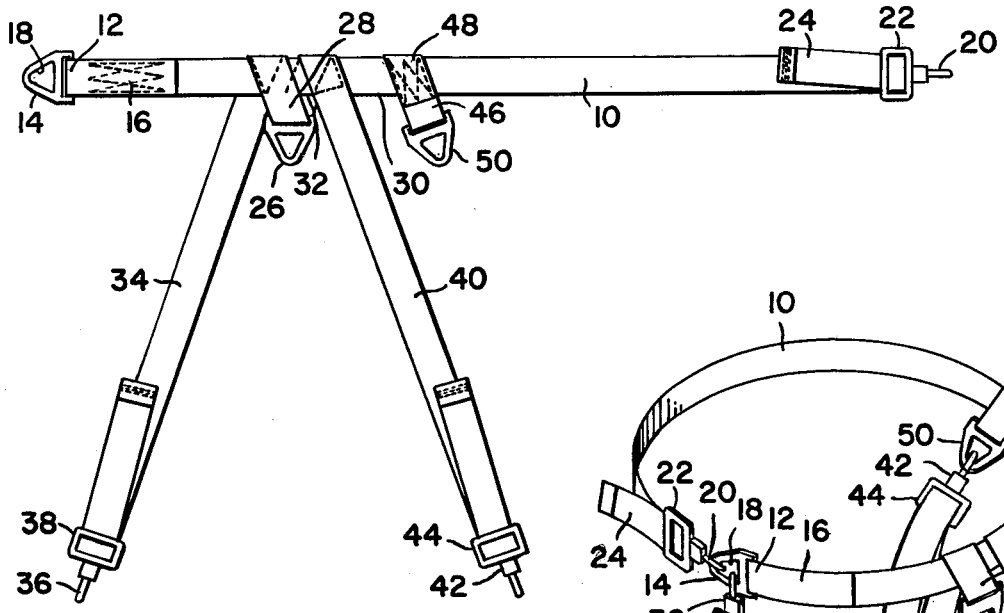
FIG. 1 is a plan view of a harness in accordance with the invention.

As illustrated in FIG. 1, the harness comprises a belt 10. This belt can be made from various materials, but is preferably made from a high-strength woven nylon webbing. Preferably, belt 10 is covered with an asphaltus coating, the purpose of which is to prevent rope friction from damaging the belt or injuring the wearer in rappelling. Belt 10 is provided at its end 12 with a metal ring 14 secured in a loop formed in the end of belt 10 by folding the end of the belt over on itself and stitching at 16. Ring 14 is preferably of the type having a triangular opening 18, this type of opening being especially adapted for connection to a snap hook.

A snap hook is provided at the opposite end of belt 10. Preferably, though not necessarily, snap hook 20 is formed integrally with an adjustment buckle 22 of the conventional type. The belt is fed through the adjustment buckle 22, leaving a loose end 24. Adjustment buckle 22 readily allows the feeding of the web belt therethrough except when tension is applied, whereupon the buckle tightly grips the belt preventing further adjustment. The adjustment buckle therefore allows continuous adjustment of the length of the belt so that a perfect fit can be achieved on the body of the wearer. It is very desirable to locate adjustment buckle 22 so that it adjusts the length of the long portion of the belt extending toward the right of the various leg straps and attachment means as shown in FIG. 1. With adjustment buckle 22 so located, the elements such as ring 14, and the leg straps and attachment means remain in a fixed predetermined relationship to one another, insuring that the harness will properly fit individuals of a wide range of sizes.

In normal use, snap hook 20 is connected to ring 14 so that the belt forms a closed loop either about the waist or about the upper torso of the wearer. Unless otherwise specified herein, the term "belt" should be understood to refer to that portion of belt 10 which extends between ring 14 and snap hook 20. The belt preferably has a maximum length of about 125 cm.

Another metal ring 26, which is preferably of the triangular type, like ring 14, is secured to an intermediate location on belt 10 by a short length 28 of flexible webbing material. Length 28 of webbing material is desirably about four-six cm. in length, measured from the lower edge 30 of belt 10. Length 28 of webbing is securely sewn to the face of belt 10, and extends from edge 30 so that a hinge is effectively formed at 32. The intermediate location on belt 10 to which ring 26 and flexible length of webbing 28 are secured is substantially offset from the point midway between the ends of the belt, preferably toward end 12. Typically the distance between end 12 of the belt and the point of attachment of webbing 28 to the belt is such that with the point of attachment directly in front of the wearer, ring 14 is located approximately at the wearer's side. The distance is typically about twenty six cm.

A first flexible strap 34 is sewn at its upper end to the face of belt 10 adjacent and to the left of flexible length 28 of webbing. A snap hook 36 is provided at the lower end of strap 34, and preferably is provided with an integral adjustment buckle 38 adapted to adjust the length of strap 34. A similar strap 40 is secured to belt 10 on the opposite side of length 28 of webbing, and is similarly provided with a snap hook 42 and an adjusting buckle 44. These straps typically have maximum length of about ninety cm.

To the right of strap 40, and spaced therefrom, is a second short length of webbing 46 sewn to the face of belt 10 at 48 and provided at its opposite end with a triangular ring 50. Length 46 of webbing is slightly longer than length 28, the portion below the lower edge 30 of belt 10 being typically about seven cm. in length. It is also preferably inclined at about a twenty degree angle, as shown, so that its ring 50 is somewhat closer to the right-hand end of belt 10 than is location 48.

From FIG. 1 it will be observed that flexible webbing 28 is located between leg straps 34 and 40, and that leg straps 34 and 40 are, in turn, located between and spaced from rings 14 and 50. Straps 34 and 40 are symmetrical about length 28 of webbing, and ring 14 and the attachment means constituted by webbing 46 and ring 50 are substantially equidistant from the location at which webbing 26 is attached to belt 10, although a minor difference in these distances will not make any appreciable difference in performance of the harness so long as the straps fit correctly about the legs (or shoulders) of the wearer. Typically the horizontal distance between the center of webbing 28 and ring 14 is twenty six cm., while the horizontal distance between webbing 28 and ring 50 is twenty three cm.

Figure 2:
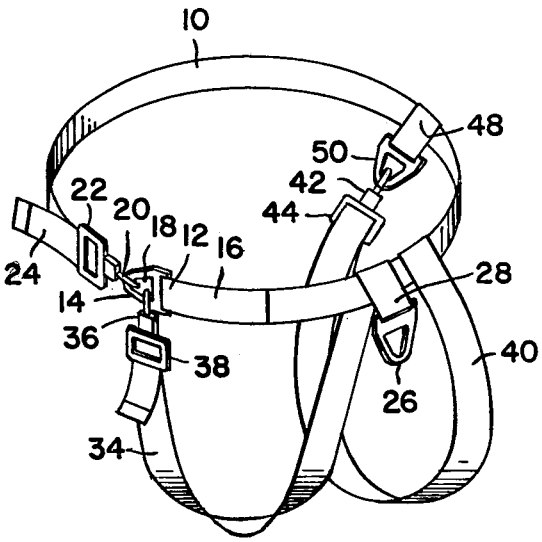
FIG. 2 is a perspective view of the harness showing its configuration when worn about the waist of a wearer for such purposes as rappelling, climbing and sliding.
Figure 3:
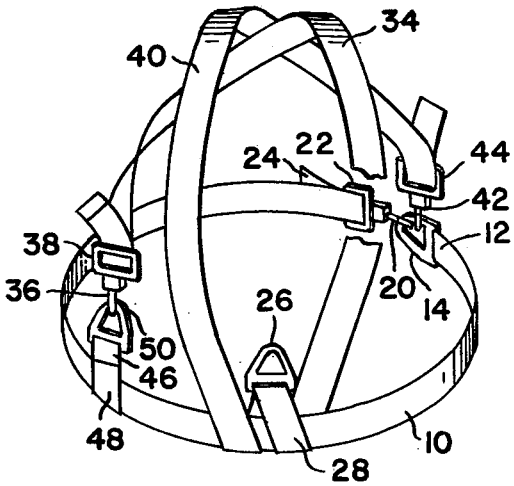
FIG. 3 is a perspective view of the harness showing its configuration when worn about the upper torso and used for the rescue of a victim or as a safety harness.

When the harness is in use, the snap hooks 36 and 42 cooperate with rings 14 and 50 either in the manner illustrated in FIG. 2 or in the manner illustrated in FIG. 3.

FIG. 2 shows the harness in the configuration in which belt 10 is worn about the waist, and straps 34 and 40 extend uncrossed between the wearer's legs. This configuration is used for rappelling, climbing, sliding, for lowering persons from and raising persons into helicopters, for rescue, and for various other purposes. Snap hook 42 connects to ring 50 so that a loop is formed by leg strap 40, webbing 46, and the length of belt 10 extending between location 48 and the location to which strap 40 is connected to the belt. Snap hook 20 is connected to ring 14 so that the belt forms a closed loop about the waist. Snap hook 36 is also connected to ring 14 so that a loop is formed by strap 34 and the length of the belt extending between ring 14 and the location at which strap 34 is secured to the belt. Ring 14 serves the dual purpose of accommodating snap hook 20 and of accommodating snap hook 36. The ability of ring 14 to serve this dual purpose is brought about in part by the offset relationship of the leg straps with respect to the midpoint of the belt which causes ring 14 to be positioned substantially at the side of the wearer. The triangular shape of opening 18 is such that snap hook 20 is positioned in one corner of opening 18 while snap hook 36 is positioned in another corner of the opening.

The offset relationship of the leg straps with respect to the midpoint of the belt also makes it easy for the wearer to attach and remove the harness quickly, especially since ring 14 is positioned at the side of the wearer rather than directly behind his back, and also because ring 14 accommodates two of the three snap hooks of the harness. As will be readily apparent to experienced rescue workers and military personnel, rapid removal of a harness is of the greatest importance in helicopter work, as a person being lowered from a helicopter can be seriously injured as a result of movement of the helicopter unless he can disengage himself from his harness immediately upon reaching the surface onto which he is being lowered.

Figure 4:
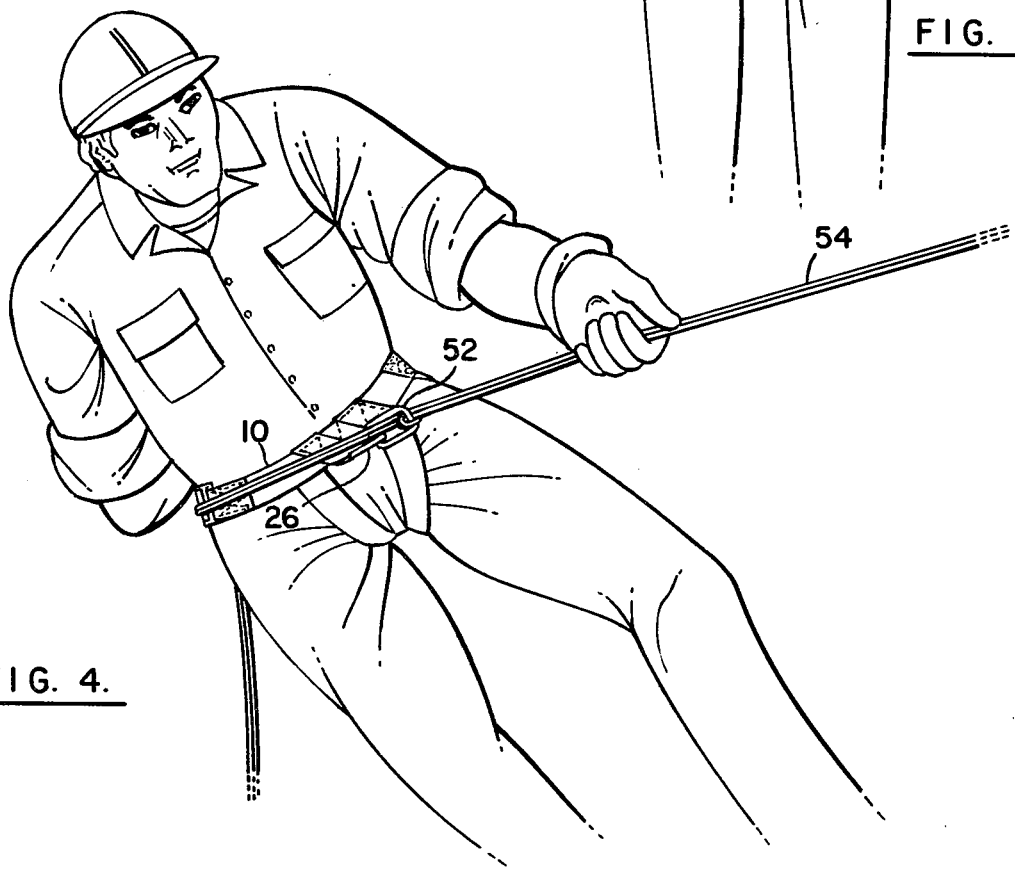
FIG. 4 is a perspective view showing the harness in use in rappelling.

One manner in which the harness is worn with belt 10 about the waist is illustrated in FIG. 4. The wearer is using the harness for rappelling, and for that purpose a snap link or "Carabiner" ring 52 is connected to ring 26, and rappelling rope 54 is wound around the snap link in the usual manner. The harness is a superior rappelling harness, particularly by virtue of the perfect fit achieved by the continuous adjustability of the belt and leg straps, and the ease and rapidity with which it can be donned and removed.

For "Australian" rappelling, the harness is worn with belt 10 around the waist, but with ring 26 behind the back. Since rings 14 and 50 are still located at the sides of the wearer when the harness is worn this way, the harness can be attached and removed very readily.

Figure 5:
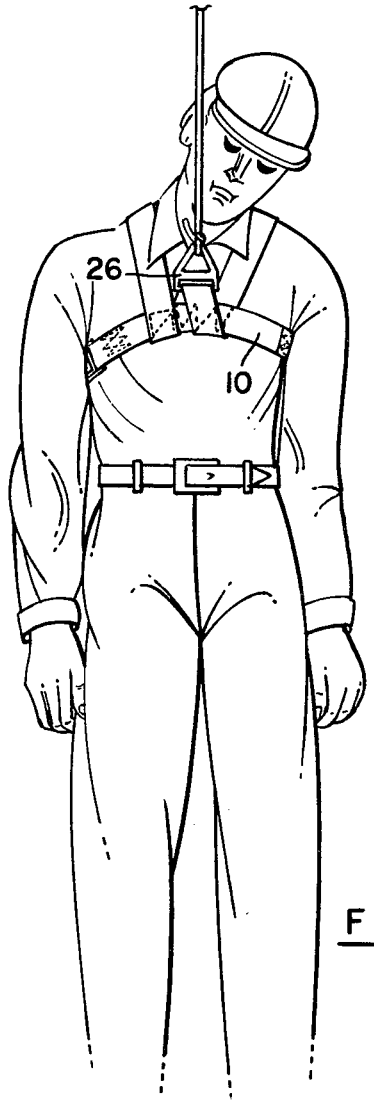
FIG. 5 is a perspective view showing the harness in use in lowering a victim.

An alternative mode in which the harness can be used is illustrated in FIG. 3, wherein belt 10 extends in a loop around the upper torso of the wearer. Here, the straps 40 and 34 cross each other at 56, and snap hook 36 connects to ring 50 while snap hook 42 connects to ring 14. In this configuration, the attachment ring 26 can be positioned either in front of or in back of the wearer, and the crossing 56 of the straps is on the back of the wearer when ring 26 is on the front, and vice versa. In this configuration, the harness can be used for raising and lowering victims, especially unconscious persons. It is also adapted for use as a safety harness for construction workers. For rescue purposes, the harness is desirably positioned so that the ring 26 is in front of the victim as shown in FIG. 5. This causes the rings and snap hooks to be positioned where the victim cannot easily reach them. Thus, even though the snap hooks may be of the quick-release type, as will be discussed below, a degree of safety is provided against the accidential (or intentional) disconnection of the snap hooks by a person being rescued.

When the rescue harness is used as a safety harness for construction workers and the like, it will normally be worn with ring 26 behind the worker's back, and therefore out of his way so that he can carry on his activities without interference. Ring 26 can be connected to a drop line through a short line connected to a drop line grabbing device of the conventional type. The ability of belt 10 to be tightened to any desired degree of tightness about the upper torso is of particular significance when the belt is worn in the configuration illustrated in FIG. 3. Belt 10 can be adjusted so that it fits sufficiently tightly that the wearer cannot slide out of the harness even if unconscious.

Figure 6:
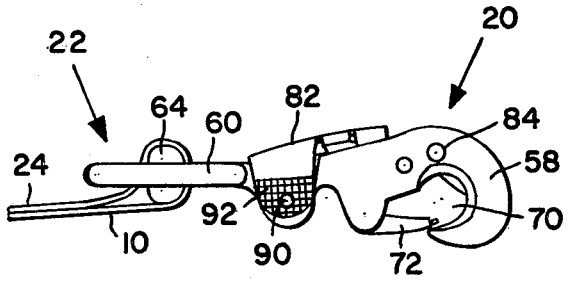
FIG. 6 is a side elevation of a preferred form of a quick-release snap hook used in the harness.
Figure 7:
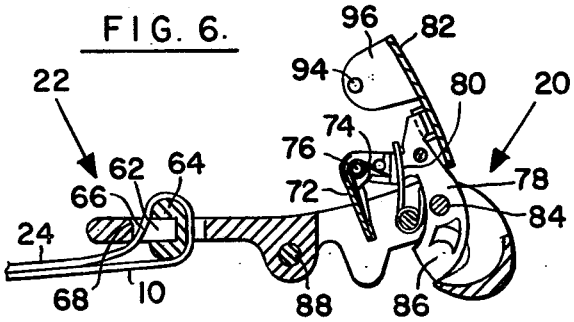
FIG. 7 is a partial section of the snap hook of FIG. 6 shown in its open condition.

The construction and operation of the integrally combined snap hooks and adjustment buckles, of which there are three in the harness of FIG. 1, are illustrated in detail in FIGS. 6 and 7, which show snap hook 20 respectively in its closed and opened conditions. Snap hook 20 comprises a hook 58 which is integrally connected to a rectangular member 60 having a rectangular central opening 62 provided with a slidable transverse locking member 64. As best seen in FIG. 7, belt 10 extends upwardly through opening 62, where it terminates in loose end 24. The adjustment buckle operates in the conventional manner. When tension is applied to belt 10, member 64 moves to the left, and clamps portion 66 of the belt against left-hand edge 68 of opening 62. When tension is not applied, however, the belt can be slid in either direction around member 64 without difficulty.

Returning to hook 58, the hook is formed so that an opening is provided at 70 for receiving a portion of ring 14. A spring loaded snap 72 cooperates with hook 58 so that opening 70 is completely enclosed. Snap 72 is normally held in the position shown in FIG. 6 by spring 74, but is pivotable inwardly about pivot 76 so that the snap hook can be readily engaged with the ring.

The assembly of snap 72 and spring 74 is supported on a pivotable element 78, which is normally held in the position shown in FIG. 6 by spring 80. Element 78 is provided with an actuator 82, which can be grasped between the thumb and forefinger, and pulled from the position shown in FIG. 6 to the position shown in FIG. 7. Element 78 is pivoted at 84, and on the side of pivot 84 opposite actuator 82, element 78 includes an extension 86, which serves to push the ring out of opening 70 when actuator 82 is pulled. Actuator 82 is held in its normal position by a spring loaded ball detent 88, which cooperates with a small hole 90 in ear 92 of the actuator. A similar hole 94 is provided on the opposite ear 96 of actuator 82, and can cooperate with another spring loaded ball detent on the opposite side of the snap hook assembly, if one is provided.

In operation, it will be seen that attachment of the snap hook to a ring is accomplished simply by the deflection of snap 72. Removal of the snap hook from a ring is accomplished by grasping the ears of actuator 82, and pulling it to the position shown in FIG. 7. This moves snap 72 out of the way, and simultaneously causes extension 86 to push the ring out of opening 70. In this way, a rapid disengagement of the snap hooks and rings can be accomplished.

Figure 8:
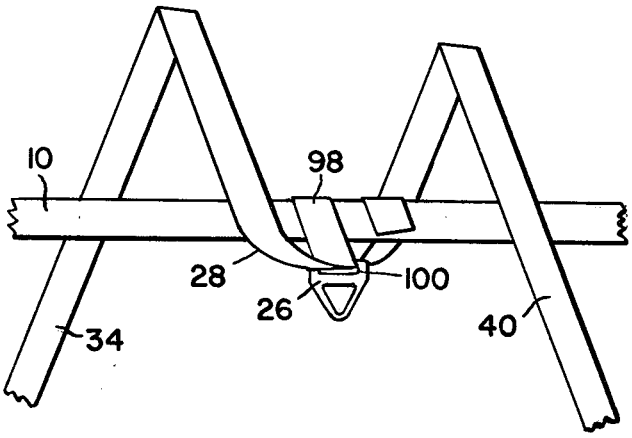
FIG. 8 is an exploded view showing the details of the attachment between the belt of the harness, its leg straps, and the short length of webbing by which the ring is secured to the belt.

Straps 34 and 40 of the harness and length 28 of webbing, which attaches ring 26 to belt 10, are desirably formed from a unitary length of webbing material as illustrated in FIG. 8. As shown in FIG. 8, the length of webbing which forms straps 34 and 40 and webbing length 28 is wound one and one-half times around belt 10. A short length of webbing material 98 is also wound one and one-half times around belt 10. Both lengths of webbing material pass through slot 100 in ring 26, and length 98 serves as a reinforcement, providing added security in the attachment of ring 26 to belt 10.

In assembly, the lengths of webbing are arranged as shown in FIG. 8, then the length of webbing from which straps 34 and 40 are formed is tightened to the condition shown in FIG. 1, and positioned so that it completely overlaps webbing length 98. The lengths of webbing are then stitched together to form a unitary harness assembly.

The principal advantage of the construction shown in FIG. 8 is that, even if the stitching connecting the straps 34 and 40 and webbing length 28 to the belt fails, ring 28 is still secured by belt 10 by reason of the fact that the unitary length of webbing which forms the leg straps is wound one and one-half times around belt 10.

The multi-purpose harness described above can be readily rolled into a compact form which can be carried, for example, in the pocket of a fireman's coat, from which it can be removed quickly and put to any desired use.

While the preferred form of the invention has been fully described, it should be understood that numerous modifications or improvements can be made to the invention without departing from its scope, which is defined by the following claims.

I claim:

1. A multi-purpose human harness for climbing, rappelling, rescue and the like comprising:

a flexible belt adapted to extend circumferentially around the waist and alternatively around the upper torso of the wearer, said belt having means for adjusting its length, and having means for removably securing its ends together to form a closed loop;

a metal ring, and flexible means securing said ring to an intermediate location on said belt;

a first flexible strap secured at one of its ends to an intermediate location on said belt on one side of and adjacent the location to which said ring is secured;

a second flexible strap secured at one of its ends to an intermediate location on said belt on the opposite side of and adjacent the location to which said ring is secured;

a pair of attachment means secured to said belt at locations such that the locations to which said flexible straps are secured to said belt are located between the locations to which said attachment means are secured;

means attached to each strap, at the end thereof opposite the end which is secured to the belt, adapted to be removably secured to either one of said attachment means; and means on each strap for continuous adjustment of its length through a range such that the harness may be worn with said flexible belt around the waist and with said first and second straps extending uncrossed between the legs and tightened about the legs, and alternatively with said belt around the upper torso and with said straps crossing each other, extending over the shoulders, and tightened about the shoulders.

2. A multi-purpose harness according to claim 1 in which the locations at which the flexible straps are secured to the belt are positioned with respect to the ends of the belt so that, when the belt is worn around the waist, and said metal ring is located directly in front of the waist, the ends of the belt are connected to each other substantially at the side of the waist, and in which both attachment means of said pair are secured to the belt on the same side of the means for adjusting the length of the belt.

3. A multi-purpose harness according to claim 1 in which the locations at which the flexible straps are secured to the belt are positioned with respect to the ends of the belt so that, when the belt is worn around the waist, and said metal ring is located directly in front of the waist, the ends of the belt are connected to each other substantially at the side of the waist, and in which said means for adjusting the length of the belt is located on the belt to the rear of the interconnection between the ends of the belt at a position such that both attachment means of said pair are secured to the belt on the same side of the means for adjusting the length of the belt.

4. A multi-purpose harness according to claim 1 in which the locations at which the flexible straps are secured to the belt are positioned with respect to the ends of the belt so that, when the belt is worn around the waist, and said metal ring is located directly in front of the waist, the ends of the belt are connected to each other substantially at the side of the waist, in which said means for securing the ends of the flexible belt together comprise a second metal ring at one end of the belt and snap hook means at the other end of the belt adapted to be removably connected to the second ring, and in which one of said pair of attachment means comprises a third metal ring secured to an intermediate location on the belt and the other of said pair of attachment means is constituted by the second metal ring.

5. A multi-purpose harness according to claim 4 in which both attachment means of said pair are secured to the belt on the same side of the means for adjusting the length of the belt.

* * * * *